US006718894B2

(12) United States Patent
Whaley

(10) Patent No.: US 6,718,894 B2
(45) Date of Patent: Apr. 13, 2004

(54) DEVICE AND METHOD FOR AUTOMATICALLY TUFTING UPHOLSTERY

(76) Inventor: Jonathon Nicholas Whaley, Harboury House, Swanbourne Road, Mursley, Buckinghamshire MK17 0JA (GB)

( * ) Notice: Subject to any disclaimer, the term of this patent is extended or adjusted under 35 U.S.C. 154(b) by 0 days.

(21) Appl. No.: 10/024,390

(22) Filed: Dec. 21, 2001

(65) Prior Publication Data

US 2003/0116070 A1 Jun. 26, 2003

(51) Int. Cl.[7] ..... D05B 3/22

(52) U.S. Cl. ..... 112/470.27; 112/80.01; 112/113

(58) Field of Search ..... 112/80.01, 104, 112/113, 169, 2.1, 2.2, 470.27; 297/218.1; 24/502; 29/91, 91.1, 91.2

(56) References Cited

U.S. PATENT DOCUMENTS

| | | | | |
|---|---|---|---|---|
| 2,416,084 A | * | 2/1947 | Morley | 219/491 |
| 3,399,432 A | | 9/1968 | Merser | |
| 3,470,834 A | | 10/1969 | Bone | |
| 4,111,347 A | | 9/1978 | Bone | |
| 5,309,612 A | | 5/1994 | Briere et al. | |
| 6,318,283 B1 | * | 11/2001 | Coulthard, Jr. | 114/475.12 |

FOREIGN PATENT DOCUMENTS

| | | |
|---|---|---|
| EP | A-844210 | 5/1998 |
| GB | 741576 | 12/1955 |
| GB | 814561 | 6/1959 |
| GB | 903464 | 8/1962 |
| GB | 910253 | 11/1962 |
| GB | 1260254 | 1/1972 |
| GB | 1474241 | 5/1977 |
| GB | 1541077 | 2/1979 |
| WO | 98/04495 | 2/1998 |

* cited by examiner

*Primary Examiner*—Ismael Izaguirre
(74) *Attorney, Agent, or Firm*—Dorsey & Whitney LLP

(57) ABSTRACT

A device for the automatic tufting of upholstery units using tufts (22) comprising a retaining link (12) with a tuft element (14*a*, 14*b*) at either end and associated with further tufts (24, 26) is provided. The device comprises engagement device (30, 34) for a tuft (22); device (20) for separating the engaged tuft (22) from the associated tufts (24); device for driving one tuft element (14*a*) and the retaining link of the engaged tuft (22) through an upholstery unit (40) and withdrawing the engagement device once the tuft is released; and device for automatically reloading the device with a further tuft. A method of automatically tufting upholstery units using such a device is also provided.

8 Claims, 13 Drawing Sheets

DEVICE AND METHOD FOR AUTOMATICALLY TUFTING UPHOLSTERY

TECHNICAL FIELD

This invention relates to an improved method for the automatic tufting of mattresses, futons, cushions and the like. The invention also relates to a device for carrying out the method.

BACKGROUND OF THE INVENTION

Mattresses and futons have long been held together by means of tufts. The tuft also serves to stabilise the outer layers of materials, tickings and fillings.

In the art, the word 'tuft' is generally understood to comprise two elements (hereinafter known as 'tuft elements') located outside each principal face of the mattress, and held together by means of a cord, strip or similar device (hereinafter referred to as a 'retaining link'), attached to each tuft element. Hereinafter the word 'tuft' when used alone will be used to describe the complete arrangement of tuft element, retaining link and further features.

One particular type of tuft known in the art is the "tape tuft" 22 illustrated in FIG. 1. This tuft comprises a strip 12 of flexible material (typically nylon, although polyethylene, polypropylene, rayon and other materials may also be used) which interacts at either end with tuft elements 14*a*, 14*b* of harder material (polymers such as nylon, polyethylene and polypropylene being preferred, although other materials such as metal and wood may also be used). Similar tufts are described in, for example, UK Patent 814651, although the tuft elements described in this patent are made of different material.

Tape tufts may advantageously be produced by moulding. As illustrated in FIG. 1, a string 10 of tufts 22, 24, 26 joined in series and comprising a continuous strip 12 interacting with tuft elements 14*a*, 14*b*, 14*c*, 14*d*, 14*e*, may be produced. The string of tufts may typically be provided on a reel or the like: the tufts are separated by cutting the strip between the tuft elements. Alternatively, the string could be supplied pre-cut into individual tufts which are then loaded into a magazine or the like.

Typically, such tape tufts are attached to the mattress using a needle, such as a ting or ejector needle, the structure of which is well known to those skilled in the art. An example of a tufting needle is given in UK Patent 903464, the contents of which are incorporated herein by reference thereto.

The mattress is first compressed to a thickness less than the length of the tape tuft to be used. One of the tuft elements is inserted into a recess in the tufting needle, leaving the other end free. The tufting needle, carrying the first tuft element, is then passed through both faces of the mattress, the second (free) tuft element being unable to pass through the hole made by the needle and consequently remaining outside the mattress. When the tufting needle exits the mattress, the first tuft element is released so that both tuft elements are located on the outside faces of the mattress. The tufting needle may further be provided with elastic means, such as a spring-loaded plunger, which ejects or otherwise aids release of the first tuft element from the tufting needle. Once the tufting process is complete, the mattress is decompressed.

Many manufacturers use a support, such as a washer, in connection with the tape tuft; a support may be provided on either or both faces of the mattress. The function of such supports is to prevent the tuft element from being pulled through the mattress ticking and to make the tuft more comfortable to sit or lie on. Such supports may be made from felt, cardboard, foam, leather or plastic. A first washer may be fitted to the proximal face of the mattress (ie the face the needle enters) by attaching it to the free tuft element, the washer being unable to pass through the mattress. When the needle emerges from the distal face of the mattress, its point may engage a second washer so that when the first tuft element is released from the tufting needle, the washer need only be disengaged from the needle point to be in the correct position. Alternatively, the second washer may be placed on the tuft element after it has been ejected from the tufting needle, before the mattress is decompressed.

The tufting method described hereinabove has traditionally been carried out manually. The operator may have to apply a considerable amount of force to drive the tufting needle through the mattress. This makes the process slow and inefficient, and repeatedly applying such forces over a long period of time may be detrimental to the health of the operator.

It would therefore be desirable to increase automation of the tufting process making the process faster and more efficient, and less reliant on manual effort.

Machines which allow the tufting needle to engage with driving means, such as a pneumatic piston or mechanical jack, are known in the art. The first tuft element is engaged with a recess on the tufting needle as described hereinabove, and the needle is then connected to, or forms part of, means which drive the needle through the mattress. An example of such a machine is described in UK Patent 910253.

However, while such machines automate some steps of the tufting process, a significant amount of manual input is still required in particular, it remains necessary to load the tuft element manually. It would therefore be desirable to provide a device and method which minimises manual input.

In particular, it would be advantageous to provide a device capable of tufting a mattress using the string of tufts described above, without the operator having to stop the device after fitting a tuft to separate the next tuft from the string.

It would further be advantageous to provide a device which aids the release of the tuft element from the tufting needle.

In addition, it would be desirable to provide a device capable of automatically placing the supports (such as washers) in their correct positions.

SUMMARY OF THE INVENTION

With the above objectives in mind, there is provided according to the invention a device for the automatic tufting of upholstery units using tufts comprising a retaining link with a tuft element at either end and associated with further such tufts, said device including:

- engagement means for a tuft;
- means for separating the engaged tuft from the associated tufts;
- means for driving the engagement means, together with one tuft element and the retaining link of the engaged tuft, through an upholstery unit and withdrawing the engagement means once the tuft is released; and
- means for automatically reloading the engagement means with a further tuft.

The device may further include means for aiding the release of the engaged tuft from the engagement means.

Preferably, the device may also comprise means for engaging and correctly placing in its supporting position at least one support (such as a washer). For example, such means could take the form of feed means arranged for cooperation with the automatic tufting device.

There is also provided according to the invention a method for the automatic tufting of upholstery units, said method including the following steps:

providing a tuft, said tuft comprising a retaining link with a tuft element at either end and associated with further such tufts;

engaging the tuft in engagement means;

separating the engaged tuft from the associated tufts;

driving the engagement means, together with one tuft element and the retaining link of the engaged tuft through an upholstery unit;

releasing the engaged tuft;

withdrawing the engagement means; and automatically reloading the engagement means with a further tuft.

The tuft used in the device and method according to the present invention is associated with further such tufts. It is preferred that the tuft is connected to a string of tufts, as described and illustrated below. In this case, the tuft may advantageously be separated from the string by cutting; for example, by means of one or more appropriately positioned blades. However, the tuft may also be associated with individual pre-cut tufts in a magazine or the like, the storage and loading of such tufts being readily apparent to those skilled in the art.

The upholstery unit is preferably compressed throughout the process. For example, heavy bars may be provided all the way across each face of the mattress, said bars capable of moving towards one another to compress the entire upholstery unit during the process and away from one another to release the upholstery unit at the end of the process. Alternatively, local compression may be applied by the application of pressure to the surface of the upholstery unit in the specific area where the engagement means is to act upon. As the engagement means moves in concert with the application of pressure to the upholstery unit, said unit is compressed. In this case, a light mesh (typically of metal) may be used at the rear of the upholstery unit to simply support said unit during the compression and tufting process. Pressure is applied preferably by an element of annular construction. In this case, when the engagement means comprises a tufting needle, the needle with the engaged tuft element and, optionally, support, can easily pass through the hole and the point of compression is centred on the needle.

The method may further include the step of aiding the release of the engaged tuft from the engagement means.

The device includes means for engaging a tuft, preferably by engaging one of the tuft elements. The means for engaging a tuft preferably comprises an ejector or tufting needle as is well known to those skilled in the art, one tuft element advantageously being inserted into a recess in such a tufting needle. As outlined above, the engagement means may further be provided with means for ejecting or otherwise aiding release of the tuft element from the tufting needle. The ejection means may preferably comprise elastic means such as a spring-loaded plunger, the spring being weaker than the breaking strength of the tuft. As the engagement means moves through the upholstery unit, it is the plunger which acts upon the tuft element, taking it through the upholstery unit. The force against the plunger may be resisted by the action of a spring. When the engagement means has passed through the upholstery unit, the retaining link becomes taut; as the engagement means continues to advance, increasing pressure becomes applied to the plunger unit. In turn this increases the force on the spring such that at a load below the breaking strength of the tuft element, the load on the spring is overcome and the plunger moves rearwards relative to the body of the engagement means. This allows the tuft element to be released from the engagement means. Alternatively, driving means such as a pneumatic piston, mechanical jack or any other suitable means may be used to move or release the plunger at the appropriate position to release the tuft element at the correct location.

The location of the tuft element in the engagement means may also be such that the action of the plunger is in the reverse sense such that the tuft element is ejected from the engagement means by the plunger pushing the tuft element from the engagement means.

The engagement means may be connected to, or form part of, means for driving the engaged tuft element through the upholstery unit. The driving means may comprise, for example, a pneumatic piston or mechanical jack, although any means suitable for driving the tuft element through the upholstery unit may be used in the device and method according to the present invention.

The device may be supported on any mechanical support means known in the art, for example, a supporting plate or other similar structure. Alternatively, the device may be adapted to be hand-held. It should however be noted that in such a case the device according to the present invention remains mechanically powered and operated the operator merely holding the device in the correct position.

A single device may be provided, the device being movable so that all sides of the upholstery unit may be tufted. Alternatively, multiple devices under common control may be provided so that several sections of the upholstery unit may be tufted at once.

Although the present invention is hereinafter described and defined with reference to the tufting of mattresses, the person skilled in the art will understand that the invention is equally applicable to other upholstery units, such as futons and cushions for settees and chairs.

The invention will now be described by way of example with reference to the accompanying drawings, wherein:

DESCRIPTION OF THE PREFERRED EMBODIMENTS

Figure 1A:
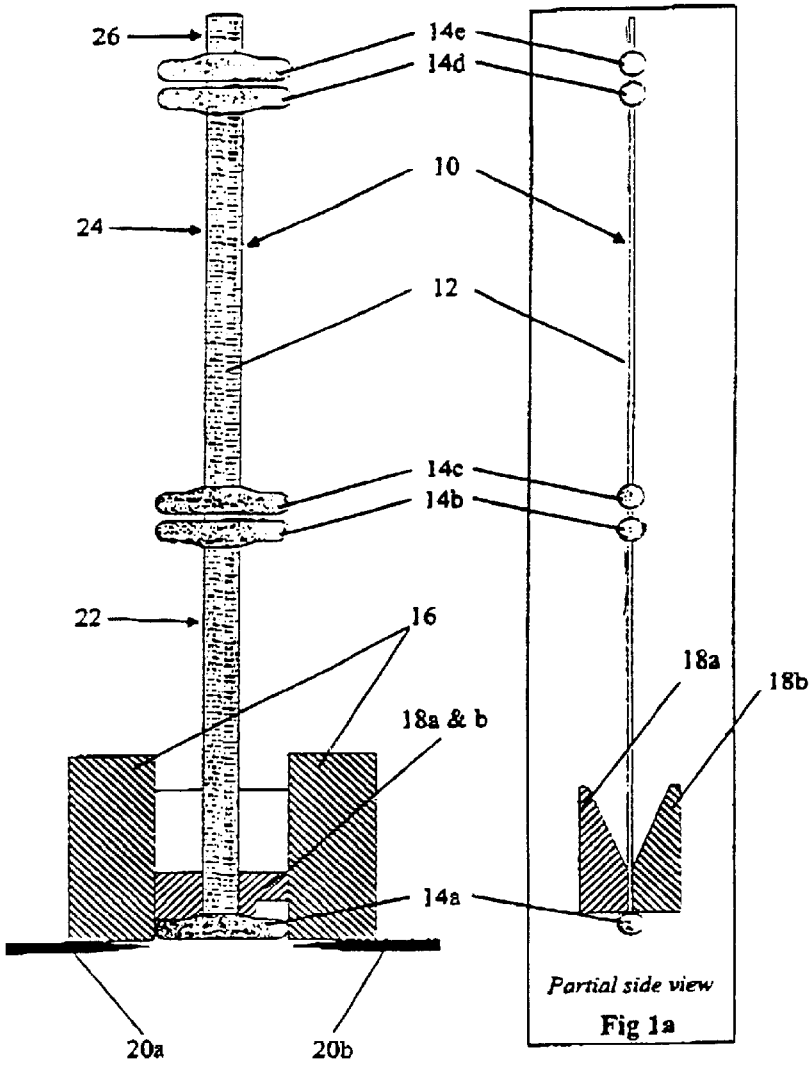
FIG. 1*a* is a side view of part of the device illustrated in FIG. 1.
Figure 1B:
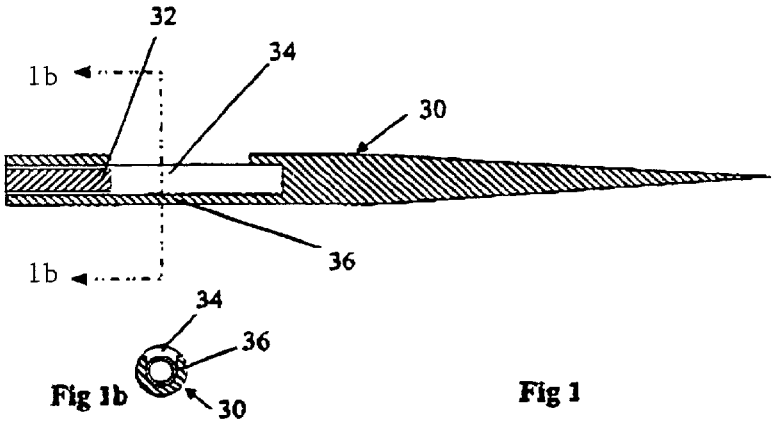
FIG. 1*b* is a section along the line 1*b*—1*b* of FIG. 1.
Figure 1:
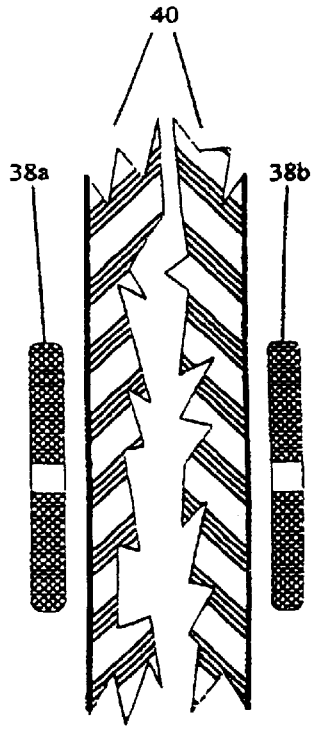
FIG. 1 illustrates the principal components of the device according to the invention in their starting positions.

FIG. 1 shows generally the tape tuft string 10 comprising retaining link 12, which is held under constant tension and interacts with tuft elements 14*a*, 14*b*, 14*c*, 14*d*, 14*e*. The string 10 passes through jaws 18*a* and 18*b* which are mounted on a sliding guide 16. The two jaws 18*a* and 18*b* operate such that they will spring open over the tuft elements 14*b*, 14*c* when drawn back up the string of tufting tapes and snap shut in a non return action. Two blades 20*a*, 20*b* are provided for cutting the tape and thereby separating it from the string. The tuft element 14*a* is positioned over a tufting needle 30 comprising plunger 32, recess 34 and outer tube 36.

FIG. 1 also shows washers 38*a* and 38*b* located either side of the mattress 40, shown in section. The mattress 40 is in compression. The principal components are in place to insert the first tuft element 14*a* into the needle 30.

In the remaining Figures, identical components are referred to using the same reference numbers used in FIG. 1. In FIGS. 1, 7–13, 15, 17 and 18, the mattress is shown in compression; in FIGS. 14 and 16 it is uncompressed.

FIG. 1*a* is a side view of the components 10, 12, 14, 16 and 18 in FIG. 1, and illustrates retaining link 12 held between jaws 18*a* and 18*b*, tuft element 14*a* being outside the jaws.

FIG. 1*b* is a section along the line 1*b*—1*b* of FIG. 1, and illustrates recess 34 cut out of the outer tube 36 of tufting needle 30.

Figure 2:
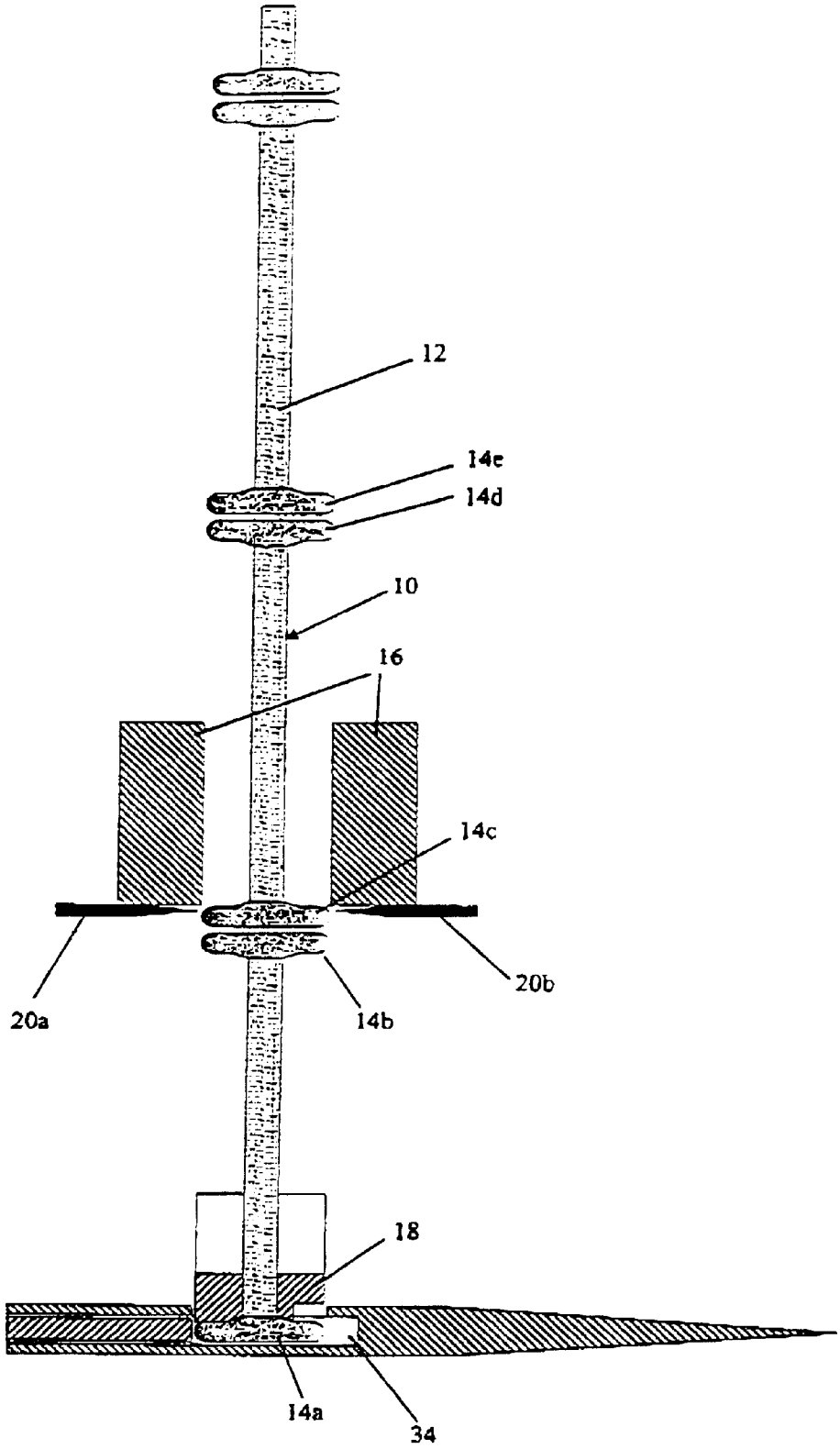
FIGS. 2 to 13 show the device according to the invention at further stages of the tufting process.

FIG. 2 shows the jaws 18 having moved forward, drawing the string of tape tufts 10 with them and positioned such that tuft element 14*a* is engaged in recess 34.

Figure 3:
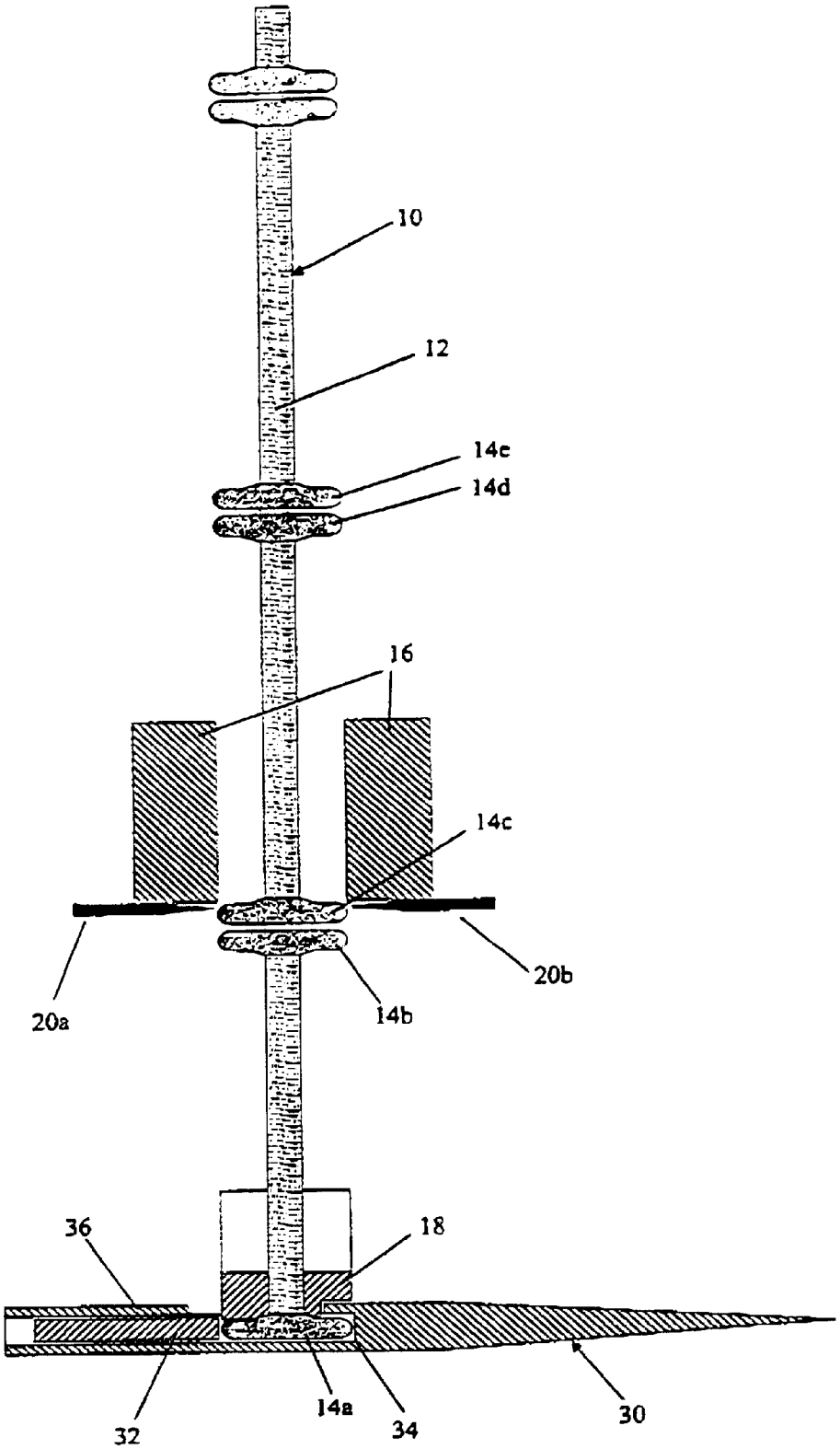

FIG. 3 shows the needle tube 36 having moved backwards with the plunger 32 remaining in place. This locks tuft element 14*a* in recess 34.

Figure 4:
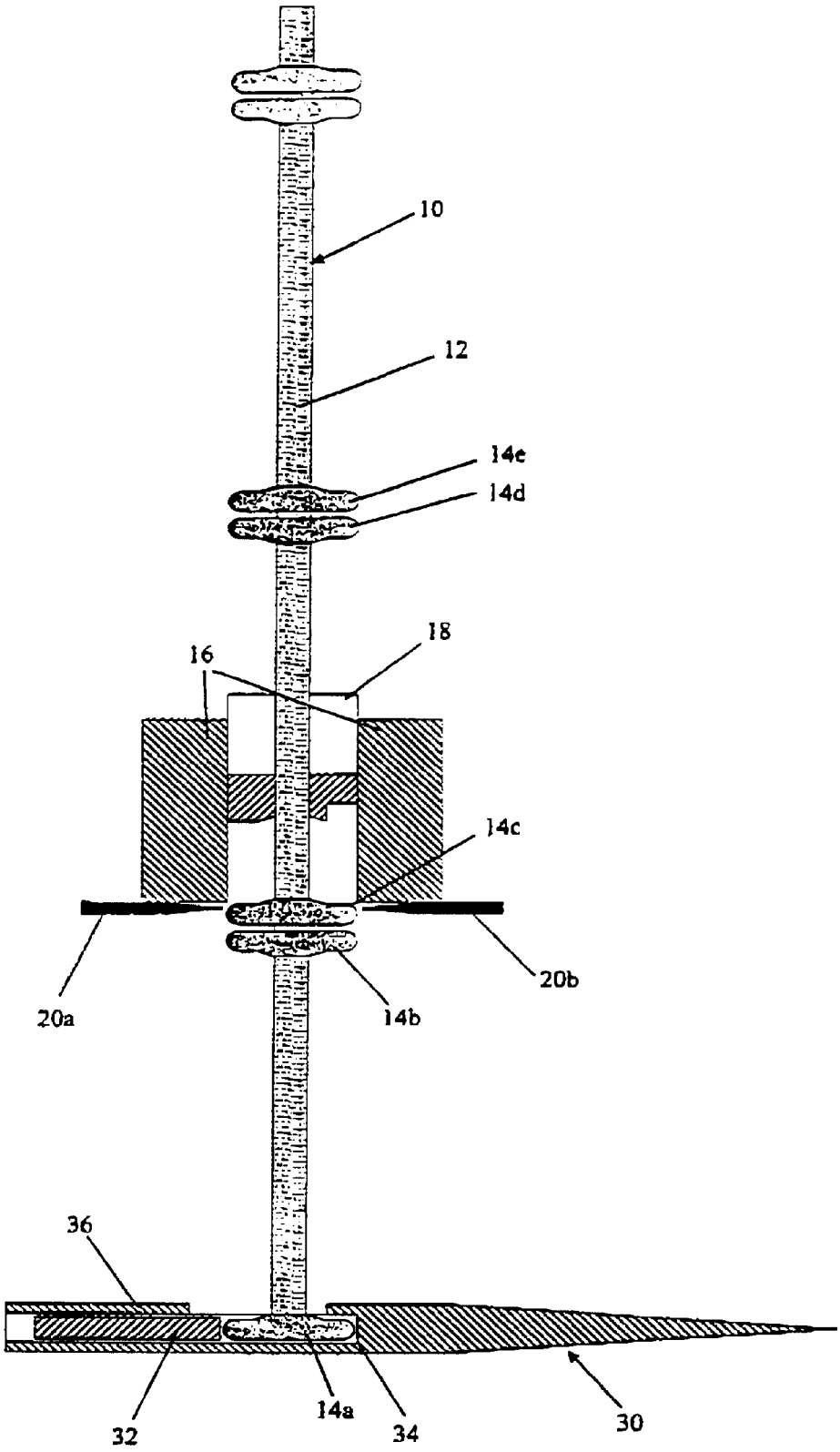

FIG. 4 shows the jaws 18 having moved back past its start position up the string 10 to an intermediate position between tuft elements 14*c* and 14*d*.

Figure 5:
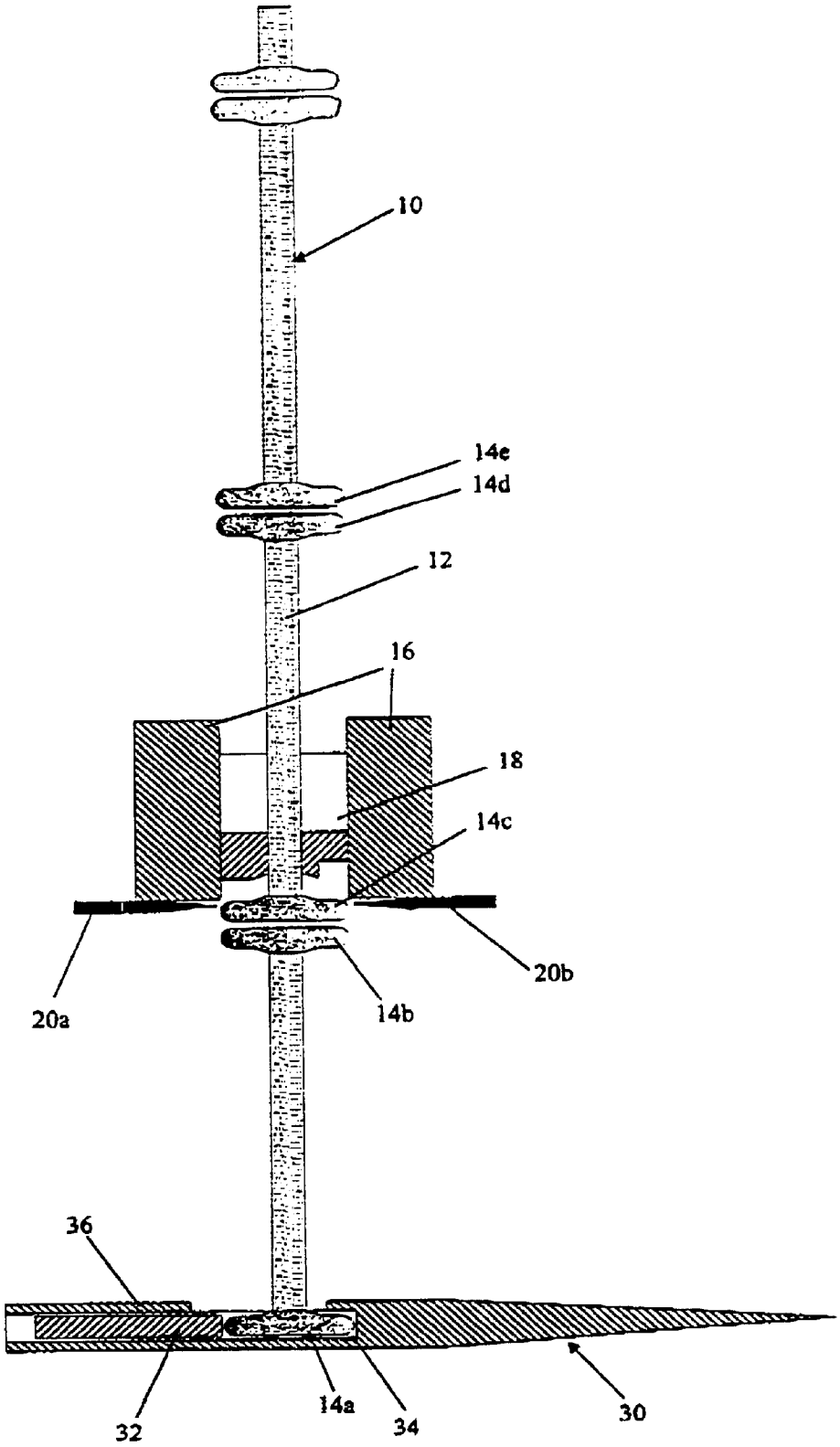

FIG. 5 shows the jaws 18 returning to the start position. Note that tuft elements 14*b*, 14*c* are in front of the start position of jaws 18.

Figure 6:
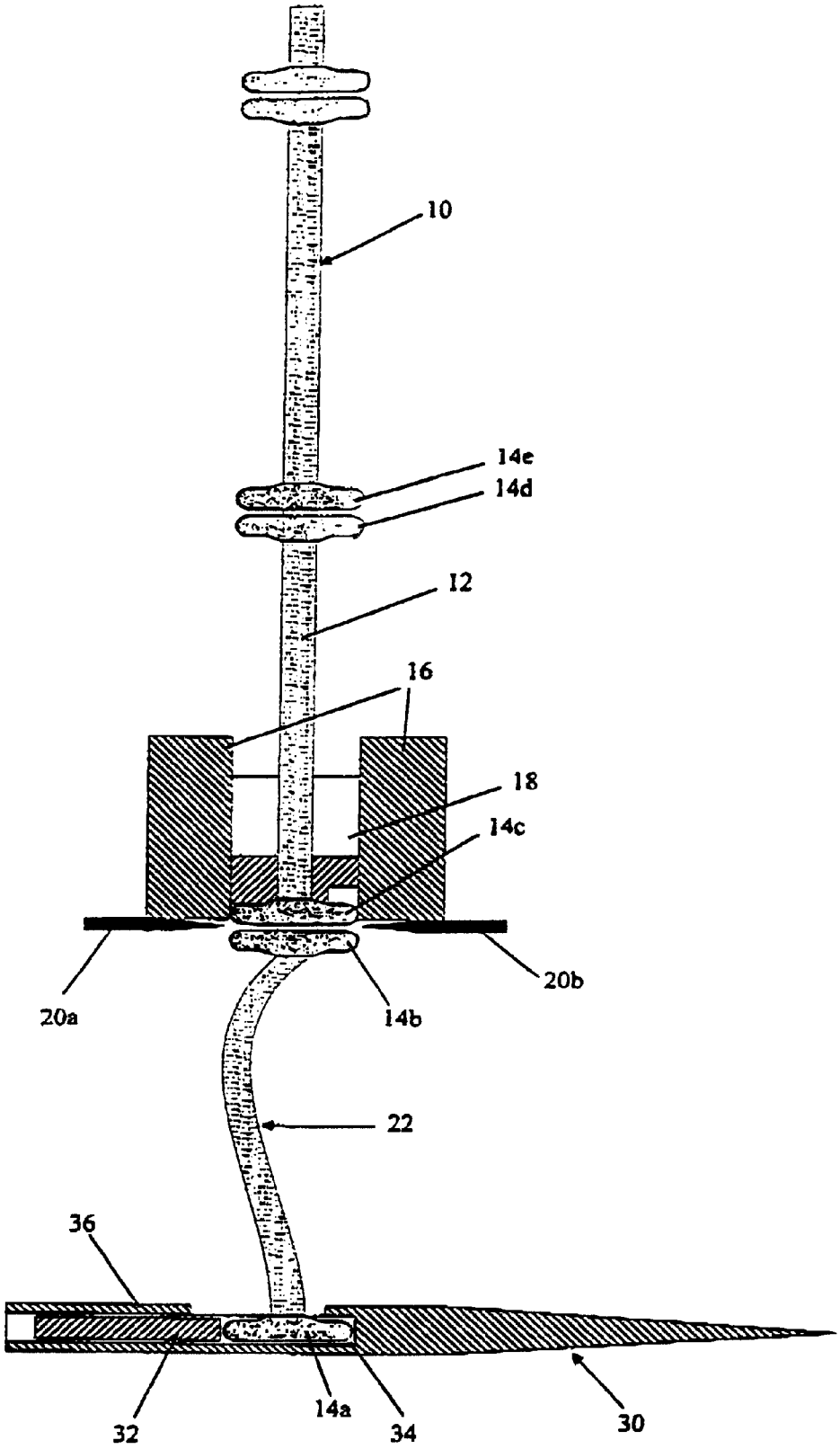

FIG. 6 shows the entire assembly of items 16, 18 and 20 having moved forward to provide slack in the first tape tuft 22 between tuft elements 14*a* and 14*b*.

Figure 7:
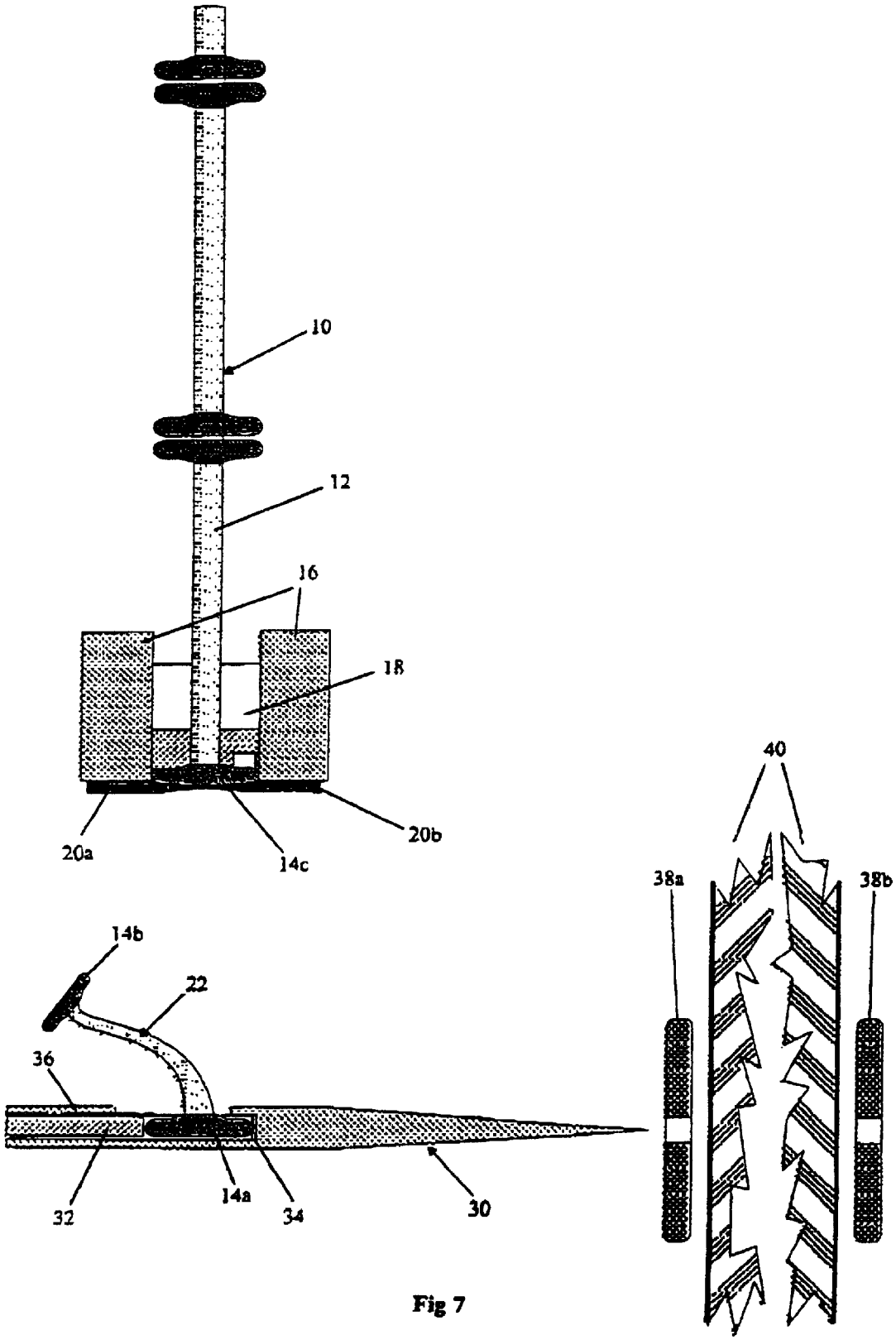

FIG. 7 shows the blades 20 having cut the first tape tuft 22 off the string 10 of tape tufts in between tuft elements 14*b* and 14*c*. The first tuft 22 is held in the needle 30.

Figure 8:
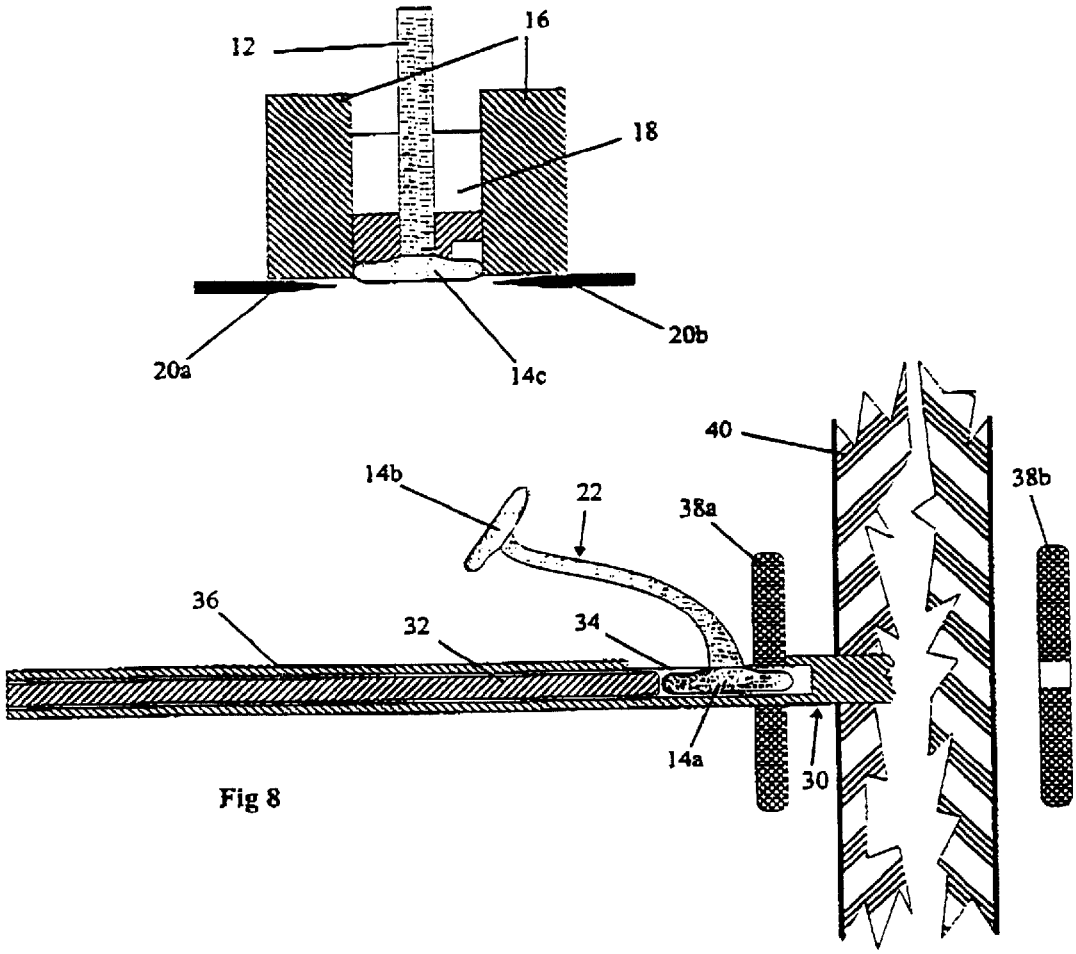

FIG. 8 shows the assembly 16, 18 and 20 having moved back to the start position. It also shows needle 30 and first tape tuft 22 entering mattress 40 having first passed through the washer 38*a* on the proximal side of mattress 40.

Figure 9:
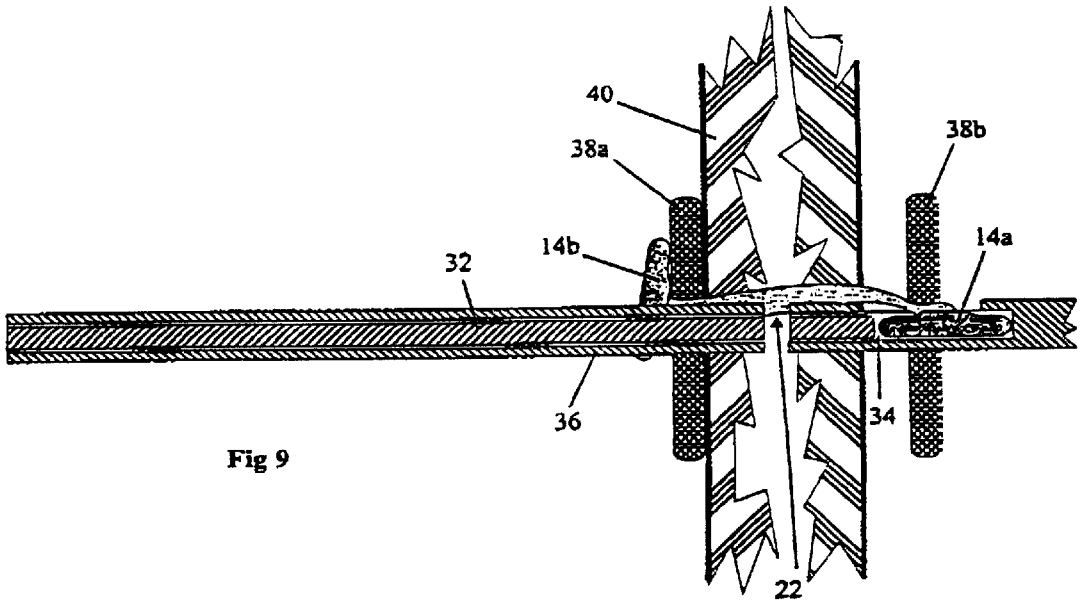

FIG. 9 shows needle 30 and tape tuft 22 passing through distal washer 38*b*.

Figure 10:
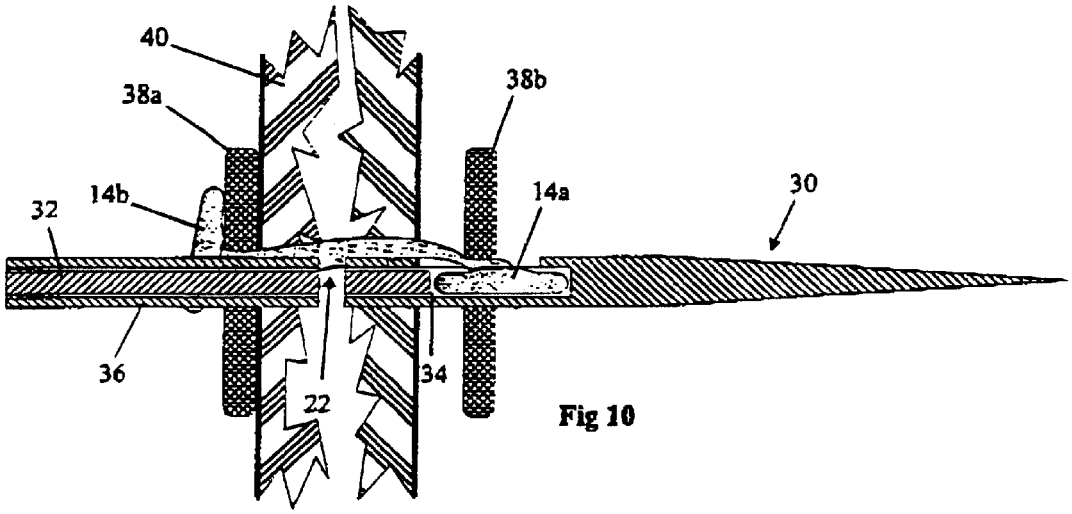
Figure 15:
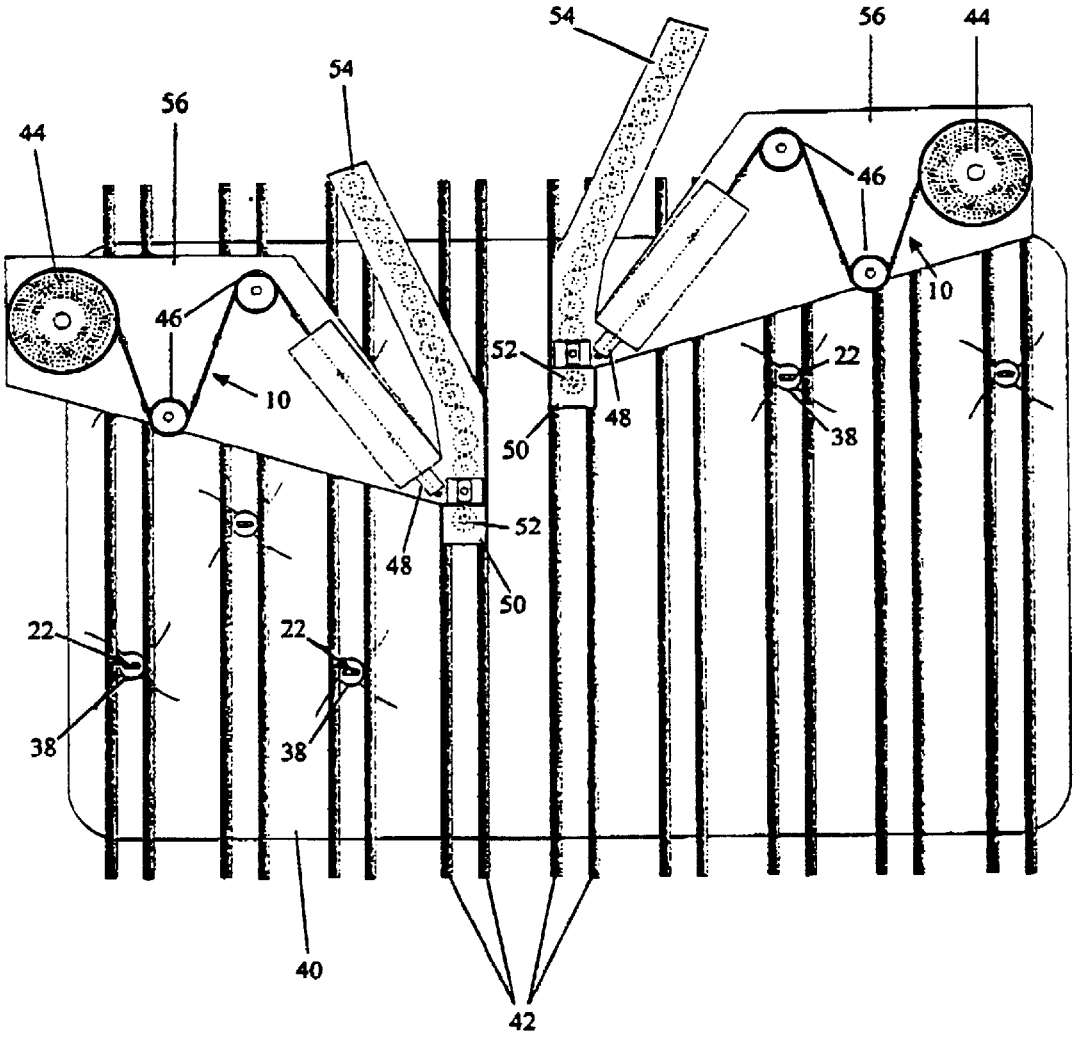
FIG. 15 is a plan view of a mattress being tufted using two devices according to the present invention.

FIGS. 9 and 10 shows needle and tape tuft 22 emerging through mattress 40, having pulled the proximal washer 38*a* free from a unit which feeds the washers (the feed unit being shown in FIG. 15).

Figure 11:
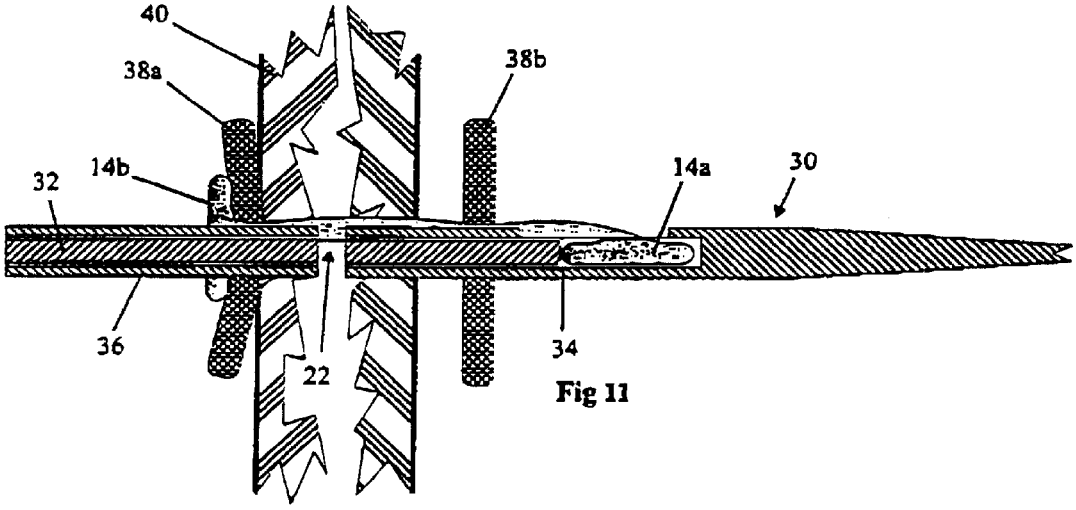

FIG. 11 shows needle 30 starting to apply tension to tape tuft 22 as it continues to advance.

Figure 12:
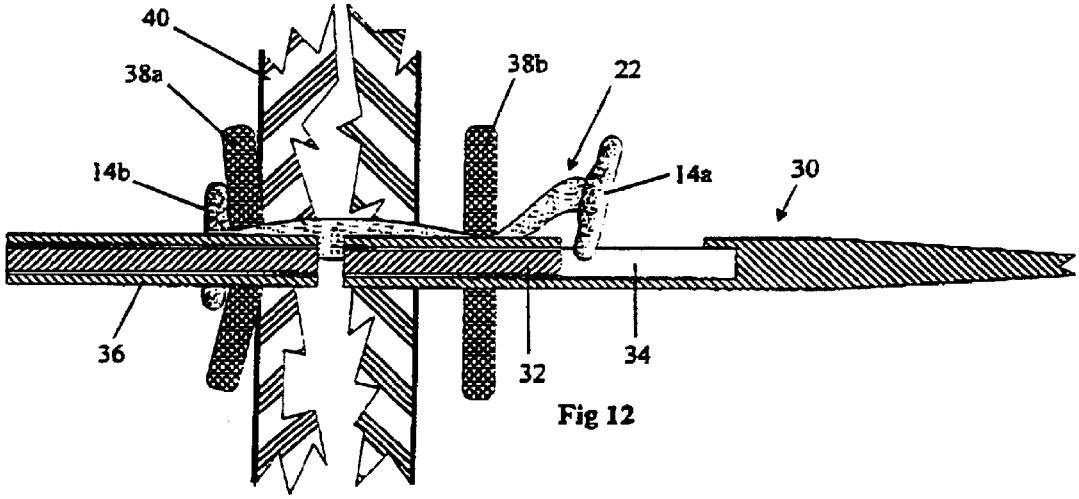

FIG. 12 shows the tuft element 14*a* being ejected from needle 30 by the rearward movement of plunger 32 relative to the outer tube 36 of the needle 30. This may be assisted by having a spring (not shown) behind plunger 32, which is compressed by the tape 22 becoming taut as needle 30 continues to move forward. Alternatively, plunger 32 may be mechanically drawn backwards by any suitable means known in the art.

Figure 13:
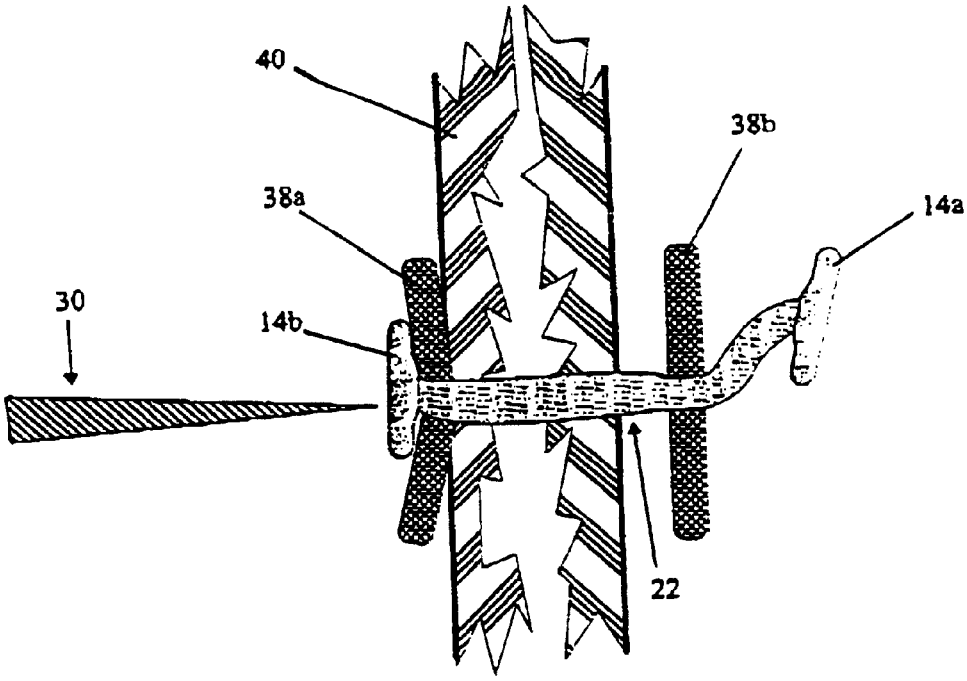

FIG. 13 shows needle 30 withdrawing from mattress 40 leaving the tape tuft 22 with washers 38*a*, 38*b* threaded on each end between tuft elements 14*a*, 14*b* and the surface of the mattress 40.

Figure 14:
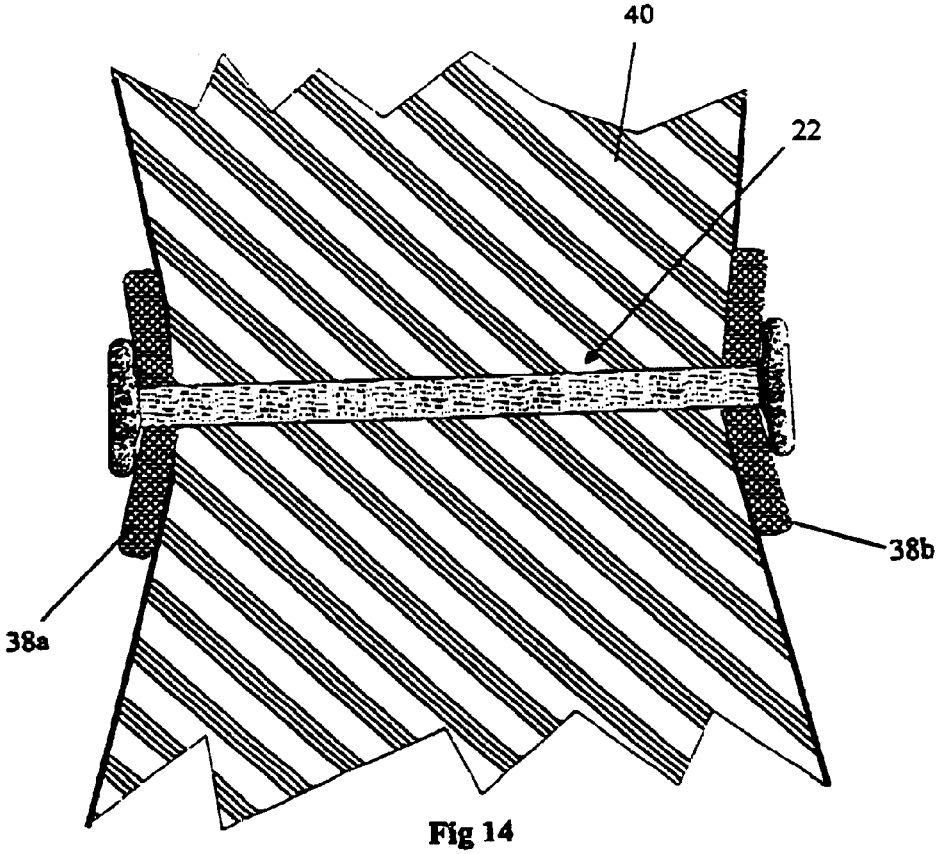
FIG. 14 illustrates a section of tufted mattress at the end of the process.

FIG. 14 shows a section of the mattress 40 uncompressed with the tape tuft 22 and washers 38 in place.

FIG. 15 shows a possible layout of the unit with the mattress 40 having been compressed by bars 42 and some tape tufts 22 and washers 38 having already been inserted. The tape tuft string 10 is shown running from a reel 44 over a tensioning device 46 in to the insert and cutting device 48 (comprising, amongst other operating mechanisms, of guide 16, jaws 18 and blades 20), the needle unit mounted on mechanism 50, the washer and needle 52 with the washer feed 54 all mounted on plate 56.

Figure 16:
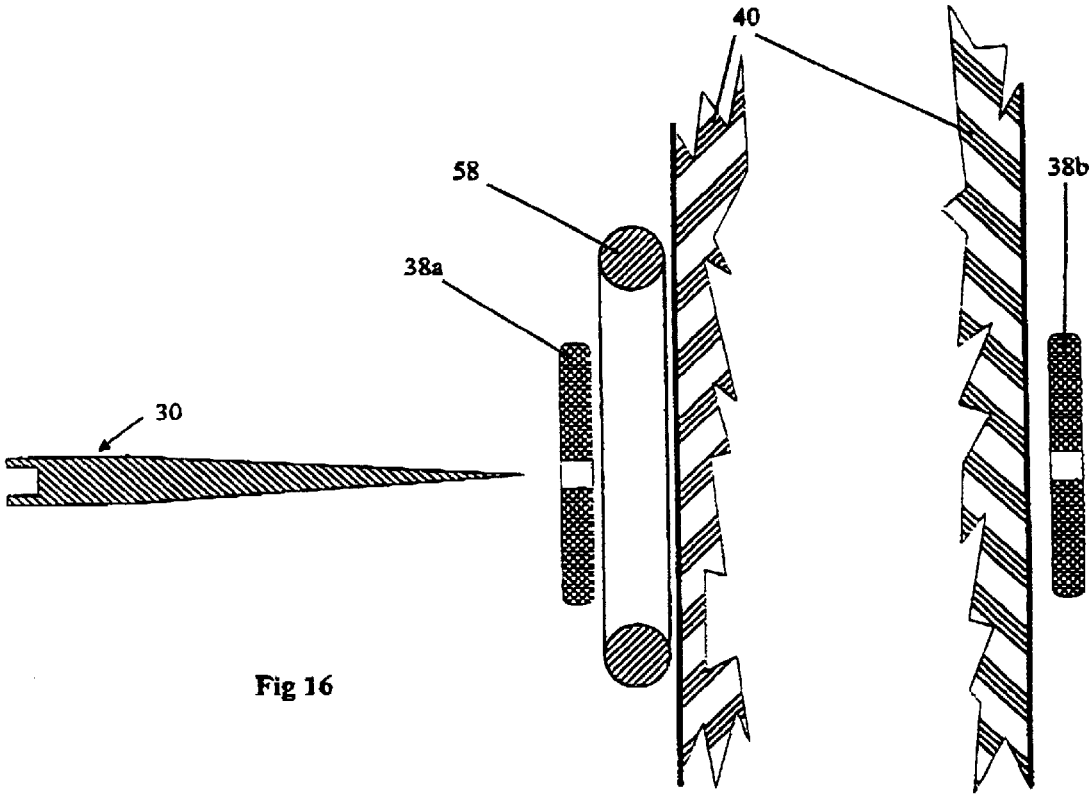
FIGS. 16 to 18 show the means of localised compression of a mattress in concert with the action of the device according to an alternative embodiment of the invention.
Figure 17:
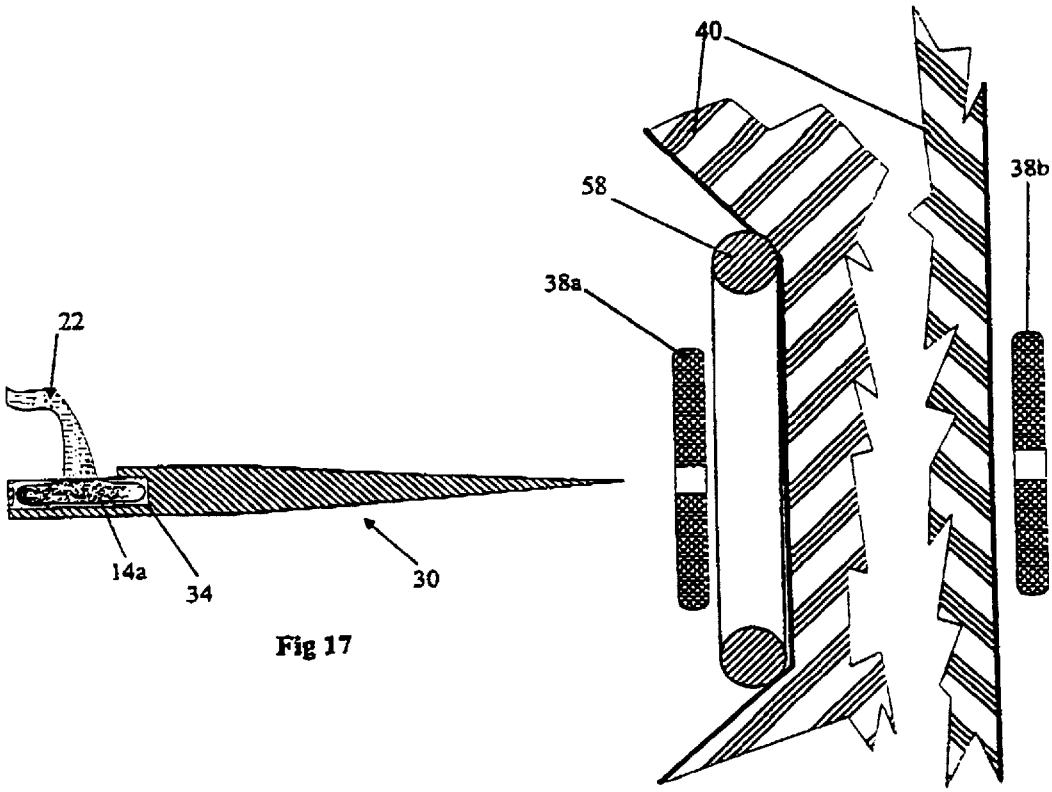
Figure 18:
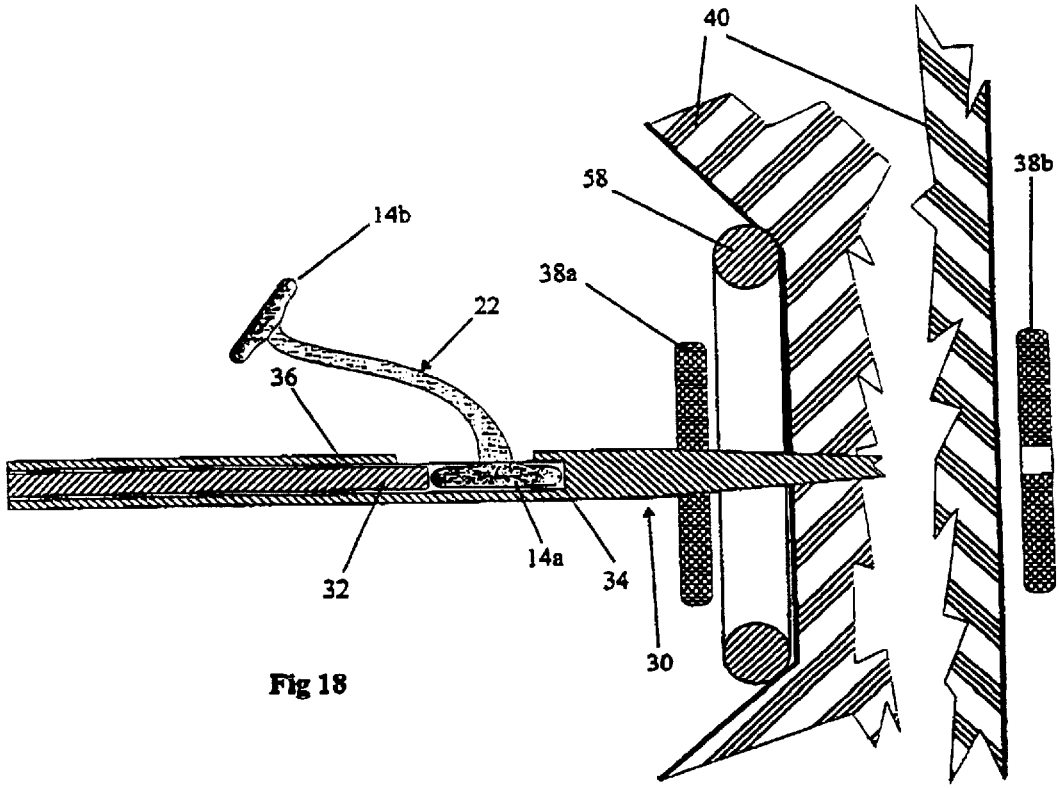

FIGS. 16 to 18 illustrate an alternative embodiment of the invention, in which local compression is applied. FIG. 16 shows the starting position of ring 58 between mattress 40 and washer 38*a*.

FIG. 17 shows the local compression action of ring 58 and the position of the needle 30 and washer 38*a*, corresponding to the position between FIGS. 7 and 8.

FIG. 18 shows the continuing action of the needle 30 and associated elements. Further steps correspond to those in FIGS. 9 to 14.

There may be several of these units which move in a pre-programmed X and Y axis utilising known technology. These units may also be mounted on both sides of the machine. Not shown, but of a simple feeding mechanism, are the washer feeds for the second washers.

The mattress would be inserted either manually or automatically in to the compression machine and once in place, the machine starts.

The first action would be to compress the mattress. The tufting units would then proceed to move and tuft in a programmed fashion until all the tufts are in place. The machine would then decompress and eject the mattress.

What is claimed is:

1. A device for the automatic tufting of upholstery units using tufts comprising a retaining link with a tuft element at either end and connected in series to at least one further such tuft said device including:

engagement means for a tuft;

means for separating the engaged tuft from the connected tufts;

means for driving the engagement means, together with one tuft element and the retaining link of the engaged tuft, through an upholstery unit and withdrawing the engagement means once the tuft is released;

means for automatically reloading the engagement means with a further tuft; and, means for engaging and placing in a supporting position at least one support, wherein the means for engaging and placing comprises feed means for the support, said feed means arranged for cooperation with the automatic tufting device.

2. A device according to claim 1, further including means for releasing the engaged tuft from the engagement means.

3. A device according to claim 2, wherein the means for releasing comprises a spring-loaded plunger.

4. A device according to claim 1, wherein the engagement means comprises a tufting needle.

5. A device according to claim 1, wherein the driving means is selected from the group consisting of a piston and a mechanical jack.

6. A device according to claim 1, wherein said tufts connected in series are connected in a string.

7. A device according to claim 6, further comprising a cutter to cut the tuft from the string.

8. A device according to claim 7, wherein the cutter is located in proximity to a tufting needle.

* * * * *